US009157321B2

(12) United States Patent
Nystrom et al.

(10) Patent No.: US 9,157,321 B2
(45) Date of Patent: Oct. 13, 2015

(54) INJECTING DEVICE, DRILL RIG AND METHOD OF ROCK BOLTING

(75) Inventors: Sven-Olov Nystrom, Örebro (SE); Jan Olsson, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 210 days.

(21) Appl. No.: 12/998,259

(22) PCT Filed: Oct. 8, 2009

(86) PCT No.: PCT/SE2009/000443

§ 371 (c)(1), (2), (4) Date: Mar. 30, 2011

(87) PCT Pub. No.: WO2010/050870

PCT Pub. Date: May 6, 2010

(65) Prior Publication Data

US 2011/0182672 A1 Jul. 28, 2011

(30) Foreign Application Priority Data

Oct. 29, 2008 (SE) ..... 0802303

(51) Int. Cl.
*E21D 20/00* (2006.01)
*E21D 20/02* (2006.01)

(52) U.S. Cl.
CPC ..... *E21D 20/003* (2013.01); *E21D 20/028* (2013.01)

(58) Field of Classification Search
CPC ..... E21D 20/028; E21D 2021/006; E21D 20/025; E21D 20/02; E21D 20/021
USPC ..... 405/259.5
See application file for complete search history.

(56) References Cited

U.S. PATENT DOCUMENTS

| | | | | | |
|---|---|---|---|---|---|
| 4,313,628 | A * | 2/1982 | Duenke | 285/115 |
| 4,344,599 | A * | 8/1982 | Herron | 248/660 |
| 4,351,625 | A * | 9/1982 | Selestam et al. | 405/303 |
| 4,588,037 | A * | 5/1986 | Combet | 175/220 |
| 4,708,533 | A * | 11/1987 | Leppanen | 405/303 |
| 4,732,509 | A * | 3/1988 | Leppanen | 405/259.5 |
| 5,114,279 | A * | 5/1992 | Bjerngren et al. | 405/303 |
| 5,165,825 | A * | 11/1992 | Wallin | 405/303 |
| 6,447,210 | B1 | 9/2002 | Coombs | |
| 2002/0119014 | A1 * | 8/2002 | Coombs | 405/269 |
| 2007/0031196 | A1 * | 2/2007 | Bruneau | 405/259.4 |

FOREIGN PATENT DOCUMENTS

EP 1538303 A1 6/2005

* cited by examiner

*Primary Examiner* — Benjamin Fiorello
*Assistant Examiner* — Edwin Toledo-Duran
(74) *Attorney, Agent, or Firm* — Mark P. Stone

(57) ABSTRACT

The invention comprises an injection device (6), for injecting fixing material in a drill hole (13) during rock bolting, comprising a hose system (12) and a feed unit (15). The hose system (12) comprises an injection pipe (10), the injection device further comprises a positioning means (33) adapted to adjust the position of the injection pipe (10) in relation to the drill hole (13) and the feed unit (15) comprises means (31, 32) adapted to drive the hose system (12) such that the injection pipe (10) enters the drill hole (13) for supplying fixing material into the hole (13) during operation.

12 Claims, 10 Drawing Sheets

INJECTING DEVICE, DRILL RIG AND METHOD OF ROCK BOLTING

TECHNICAL FIELD

The invention relates to an injection device for injecting fixing material in a drill hole when rock bolting, a drill rig for rock bolting and a method of rock bolting.

BACKGROUND OF THE INVENTION

One of many methods of reinforcing rock is to reinforce the rock with reinforcing bars embedded in a solidified fixing material. The fixing material is defined as any suitable bonding for example cement or two component resin.

According to a method using resin cartridges, a hole is drilled in the rock at first and one or several resin cartridges are injected in the hole. Each cartridge comprises at least two closed chambers containing one component each. Then, a reinforcing bar is introduced into the hole during rotation. The rotating reinforcing bar is during the introduction pushing the resin cartridges such that the cartridge compartments tear up and the two components are mixed by the rotating reinforcing bar. Mixing the components forms a compound, which hardens and is solidified during the rotation, usually in one or some minutes. The bolt is threaded in the outer end and a nut and a plate are attached to the bolt end to protect the hole and tension the bolt as a final step.

One way of injecting resin cartridges is to shoot the cartridges into a drilled hole through an injection pipe by the force of compressed air. The injection pipe is usually in the form of a stiff thin-walled plastic tube and is connected to a first end of a hose. The injection pipe is moved into the drill hole by a feeding device. Resin cartridges are placed in the hose and shoot into the drill hole by the compressed air supplied in the other end of the hose.

The dimension of the resin cartridges varies, but can have a diameter of e.g. 20-35 mm and a length of 400-500 mm in the case of a drill hole with a diameter of 30-40 mm.

One example, in injecting a resin cartridge with a diameter of 20 mm in a drill hole with the diameter 30 mm an injection pipe with the inner diameter of about 22 mm and outer diameter of about 26 mm is used.

Cement can be used instead of resin for fixing the reinforcing bar. Instead of shooting resin cartridges into the drill hole via the injection pipe, it is possible to pump the cement into the hole via the hose and the injection pipe.

A problem with the injection devices of the kind described above is that a drill hole can be damaged around the orifice of the drill hole and a distance into the rock, due to earlier blasting activities. In the case of resin cartridges, it causes the resin cartridges to get stuck in the entrance of the drill hole or alternatively on the way into the drill hole. In the case of cement, it causes the cement to leak out of the hole.

Another problem is when the fixing material misses the drill hole. This is a problem irrespective of type of fixing material.

U.S. Pat. No. 4,708,533 teaches a device for guiding a concrete feeding hose. The concrete feeding hose is therein passed by means of a feeder from a reel into a guide head supported on a feeding beam of a drilling equipment and further through the guide head into a hole drilled in the rock, and is passed back on to the reel in proportion as the hole is filled. In order to protect the feeder of the concrete feeding hose against dirt and mechanical damage, the concrete feeding hose is pushed into the guide head through a flexible guiding means.

Thus, there are needs to secure the insertion of fixing material into a drill hole during rock bolting to achieve an effective and high quality rock bolting.

These needs cannot be fulfilled by the injection device according to the above-mentioned prior art.

SUMMARY OF THE INVENTION

It is an object of the invention to improve the efficiency and quality of rock bolting.

The problem to be solved is to eliminate the risk of destroyed injection pipes, lost fixing material and/or left empty drill holes i.e. increase the safety and provide a safe injection of fixing material and consequently a safe rock bolting.

According to an aspect of the present invention, there is provided an injection device, for injecting fixing material in a drill hole during rock bolting, comprising a hose system and a feed unit. The hose system comprises an injection pipe. The injection device further comprises a positioning means adapted to adjust the position of the injection pipe in relation to the longitudinal axis A of the drill hole. The feed unit comprises means adapted to drive the hose system such that the injection pipe enters the drilled hole for supplying fixing material into the drill hole during operation.

The positioning means prevents the injection pipe from missing the orifice/entrance of the drill hole.

The diameter of the drill hole is decided in relation to the choice of rock bolt. When considering the drill holes diameter, the injection pipe shall be as thin-walled as possible to let the resin cartridges be as coarse as possible.

The feed unit comprises means adapted to drive the hose system e.g. feed rollers or a hydraulic cylinder.

In one alternative, the driving means is driving on a flexible injection feed hose. This eliminates unnecessary wear of the injection pipe.

In an alternative, the hose system comprises an injection feed hose. In another alternative, the hose system comprises an injection hose. In still another alternative, the hose system comprises an injection feed hose and an injection hose.

The positioning means comprises a guide adapted guide the injection pipe. The guide comprises two separate guiding surfaces arranged separated along the Axis A. This design results in an injection pipe being coaxial with the guide when passing the guide.

According to an alternative of the invention, the positioning means comprises a first moving means adapted for moving the guide laterally and linearly along an axis C arranged in a plane crossing the axis A.

In one alternative, the positioning means comprises a second moving means adapted for moving the guide by tilting such that the symmetry axis of the guide is moving in a plane crossing the axis C.

According to a second aspect of the present invention, there is provided a drill rig comprising an injection device for injecting fixing material in a drill hole during rock bolting.

According to a third aspect of the present invention, there is provided a method of injecting fixing material by an injection device in a drill hole during rock bolting. The injection device comprises an injection pipe for supplying fixing material into the drill hole and a positioning means comprising a guide adapted to guide the injection pipe in relation to the drill hole. The method comprises operating a first moving means to linearly move the guide along an axis C in a plane crossing the drill/operation axis, operating a second moving means to tilt the guide around the axis, such that the guide with the injection pipe is precision adjusted and the injection pipe has its longitudinal axis close to coaxial with the drill/operation axis, moving the injection pipe into a drill hole and supply fixing material into the hole, and pull the injection pipe out of the hole and finalize the bolting.

An alternative method according to the invention comprises moving the positioning device with the guide into an injection position such that the guide is coarse adjusted in relation to the axis of operation. In an alternative, the method comprises turning the positioning device around the axis (C).

In an alternative of the invention, the method comprises precision adjusting the guide with the injection pipe until the injection pipe has its longitudinal axis coaxial with the drill/operation axis.

The invention is considered to comprise some alternatives not explained in detail e.g. the hose system comprises an injection pipe and further an injection feed hose and/or an injection hose. The driving means is adapted to drive at least one of the injection pipe, the injection feed hose or injection hose.

BRIEF DESCRIPTION OF THE DRAWING

The invention will be explained more closely by the description of different embodiments thereof and with reference to the appended drawing in which.

DESCRIPTION OF ALTERNATIVE EMBODIMENTS

Figure 1:
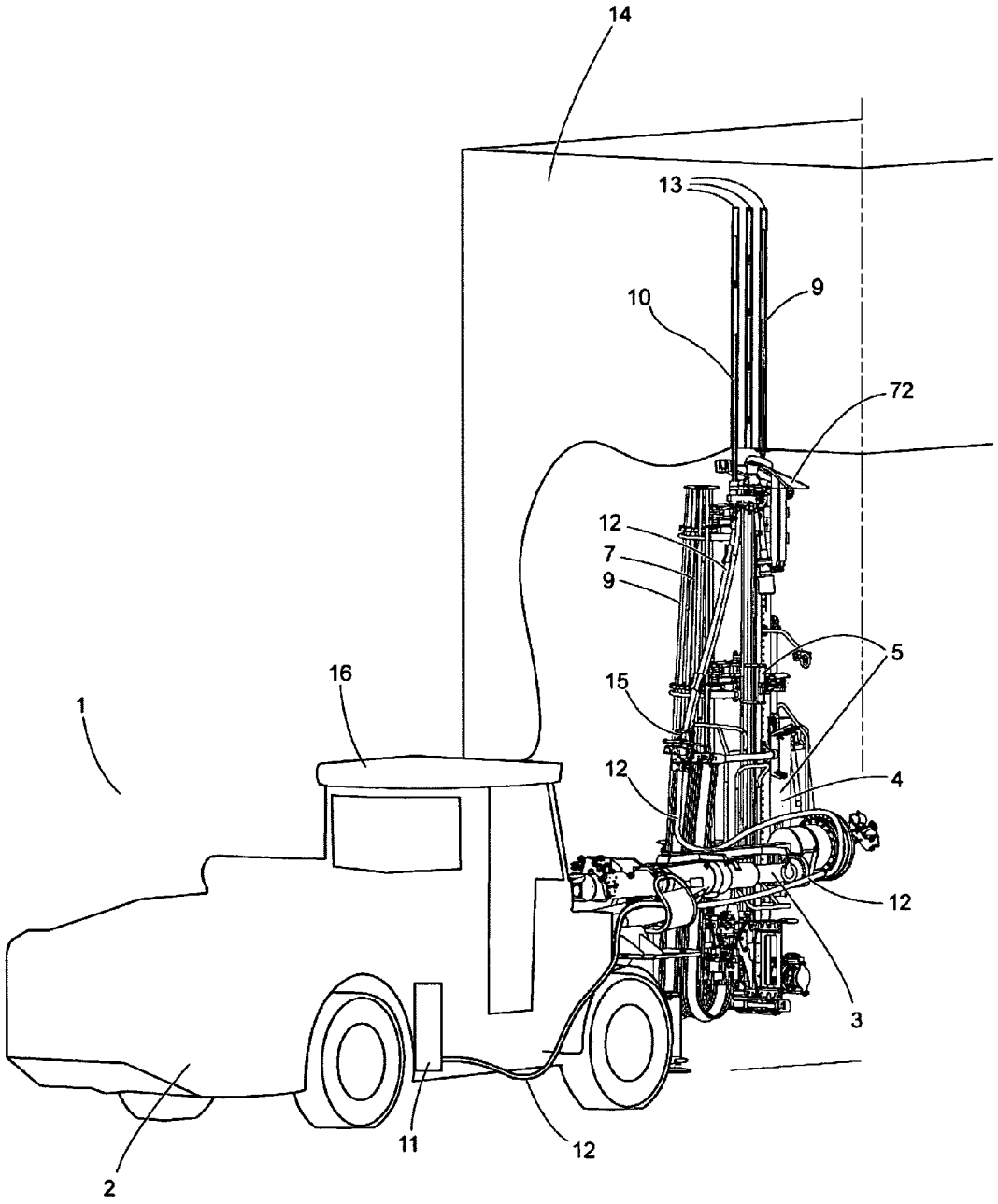
FIG. 1 is a rock drill rig comprising a mechanized bolting unit according to the invention.

FIG. 1 is a drill rig 1 comprising a carrier 2 a telescopic boom 3 and a feed holder 4 arranged connected to the boom 2, where the feed holder 4 can be tilted/rotated around a longitudinal axis of the boom 3. The drill rig further comprises a mechanized bolting unit 5 comprising an injection arrangement 6. The mechanized bolting unit 5 is arranged movable along the feed holder 4. The drill rig is adapted for rock bolting using any suitable fixing material as defined above. The feed holder further comprises means 72 for supporting the feed holder 4 towards the rock surface.

The mechanized bolting unit 5 comprises a magazine 7 storing reinforcing means 8 e.g. bolts 9. The mechanized bolting unit 5 will be explained more in detail below.

The injection arrangement 6 comprises an injection pipe 10, means 11 for storing fixing material and a hose system 12 connected to the storage means 11 for supplying fixing material into a drilled hole 13 in a rock 14. The injection pipe 10 is moved in and out of the drilled hole 13 by a feed unit 15 comprising driving means. The injection arrangement 6 will be explained more in detail below.

The drill rig can be remote controlled by an operator via wire or wireless, but can also be controlled by an operator being inside a cab 16 on the rig. The operator can control the drill rig either manually, automatically or semi-automatically.

Figure 2:
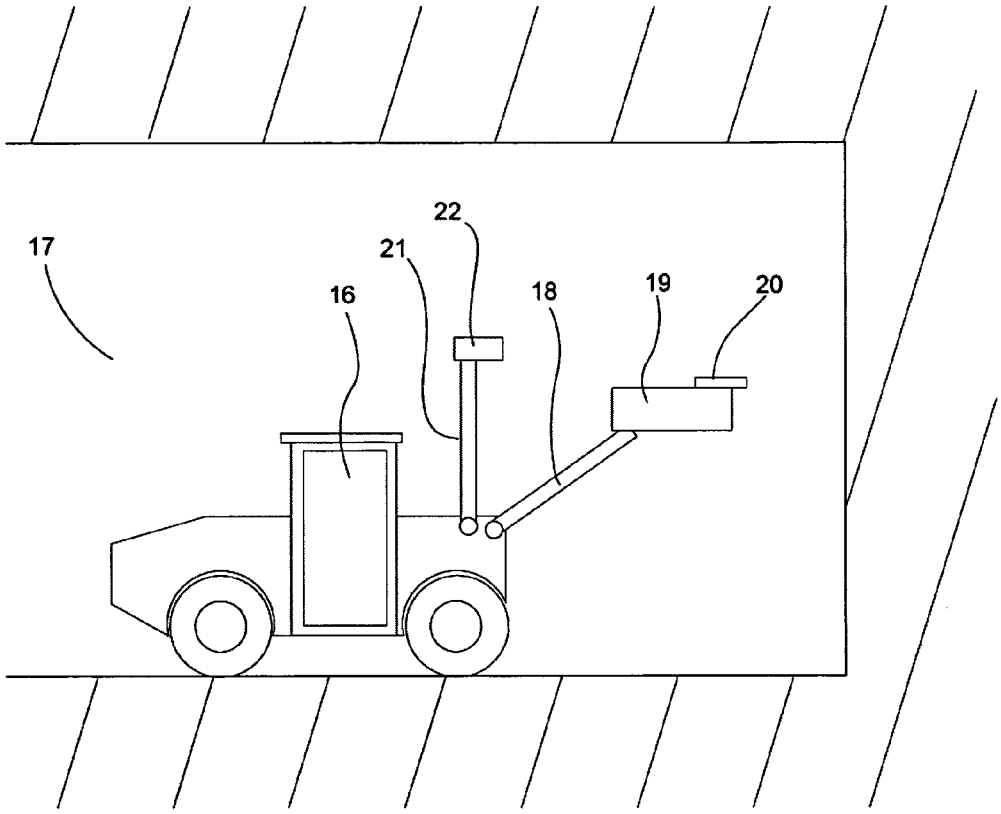
FIG. 2 is a schematic view of an alternative drill rig comprising a mechanized bolting unit according to the invention

FIG. 2 is an alternative drill rig 17 comprising a first boom 18, a drill beam 19 and a drilling machine 20. The alternative drill rig 17 comprises a second boom 21 comprising various equipment for example an injection device 22 adapted for injecting either cement or resin cartridges.

Figure 3:
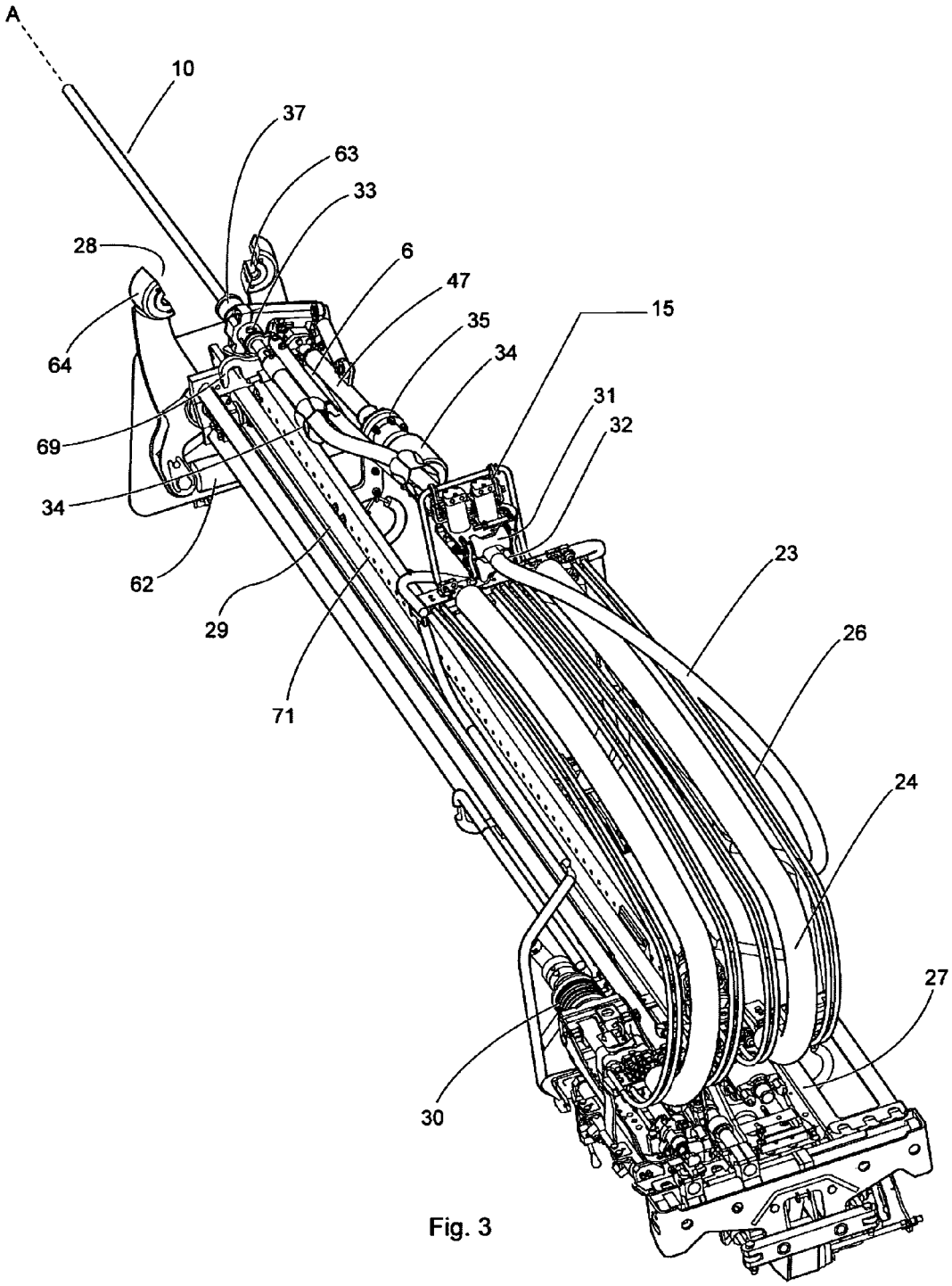
FIG. 3 is an injection arrangement according to the invention with the bolt magazine excluded.

A mechanized bolting unit 5 comprises a bolt magazine as mentioned above but this unit is lacking in FIG. 3 to facilitate the presentation of the rest of the unit. The mechanized bolting unit 5 comprises a hose system 12, as mentioned above. In FIG. 3, the hose system comprises an injection pipe 10, an injection feed hose 23 and an injection hose 24 connected to the fixing material storage means 11 (FIG. 1).

The injection feed hose 23 is connected to the injection pipe 10 in a first threaded hose coupling 25 (FIG. 5) and the injection hose 24 is connected (connection means not shown) to the storage means 11 (FIG. 1).

The injection feed hose 23 and the injection hose 24 are coupled together in a second threaded hose coupling 26. Consequently, the hose system 12 and the storage means 11 are adapted to supply fixing material into drilled holes 13 during rock bolting. The fixing material is either cement pumped into the hole or resin cartridges to be shoot into the hole by e.g. compressed air as mentioned above.

Figure 4:
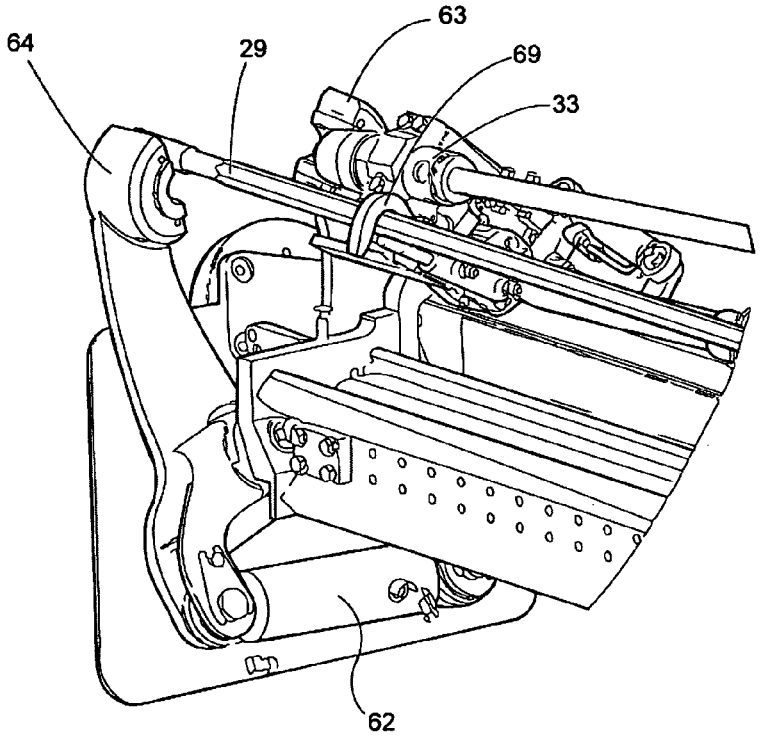
FIG. 4 is a part of the arrangement in FIG. 3 in an alternative position.

The mechanized bolting unit 5 further comprises a drilling machine 27 adapted to rotate a drill steel 29. The drilling machine 27 is arranged movable along the feed beam 71. The mechanized bolting unit 5 also comprises a drill centralizer 28 comprising a first 63 and a second jaw 64 arranged to be opened and closed by a hydraulic cylinder 62 (FIG. 4).

In the closed position (not shown), the jaws 63, 64 form a circular opening through which the drill steel 29 is acting during drilling. The closed jaws are adapted to centralize the drill steel 29 to be coaxial with the desired longitudinal drilling axis A.

In the opened position, the jaws 63, 64 are separated and the drill centralizer 28 is inactivated (FIG. 3).

The mechanized bolting unit 5 further comprises a hydraulic turning/rotation actuator 35 with a distance axle 47 adapted to rotate along its longitudinal axis B (FIG. 8) between three positions with defined orientation relative axis B; a parking position, a gripping position and an injecting position.

A positioning device 33, holding a guide 37, is connected to the distance axle 47 and is arranged to follow the turning of the turning actuator 35. The injection pipe 10 is arranged to pass through the guide 37 and the positioning device 33 is adapted to level the injection pipe 10 at a drill hole.

The turning of the distance axle 47 places the positioning device 33 with the guide 37 in the three exact positions when looking internal the mechanized bolting unit. However, movements in the drill rig during operation causes small undesired movements of the positioning device 33 such that the guide 37 is offset axis A, the axis of operation, when turned into the injection position.

The positioning device 33 is arranged to compensate these movements through precision adjusting the position of the guide 37 and thereby the injection pipe 10 in relation to a drilled hole 13. The adjusting operation will be explained below in connection with FIG. 8.

In FIG. 3, the turning actuator 35 is in its injection position with the guide 37 and consequently the injection pipe 10 arranged and adjusted by the positioning device 33 to be coaxial with the axis of operation A.

A feed unit 15 comprising a pair of feed rollers 31, 32 is acting on/driving external on the injection feed hose 23 and the feed hose is moved back or forth due to friction forces. This in turn makes the injection pipe 10 move back or forth. In the injection position, the injection pipe 10 is moving in or out of a drill hole 13. At least one hose guide 34 is guiding the injection pipe 10 and/or the injection feed hose 23 during operation.

The exchange of an injection pipe is easy done by dismounting the first threaded hose coupling 25 in a position between the feed unit 15 and the positioning device 33. Then, a new injection pipe is mounted.

In the case of injecting resin cartridges, the mechanized bolting unit 5 further comprises a bolt rotator 30. The rotation of the bolt tears up the resin cartridges allowing the at least two components to mix and then solidify, as described above.

In FIG. 4, the turning/rotation actuator 35 is in its gripping position. The positioning device 33 comprises a hook 69 and in the gripping position it is gripping the drill steel 29. During tilting, the hook 69 will force the drill steel 29 to bend to leave room for the injection pipe to enter the injection position.

Figure 5:
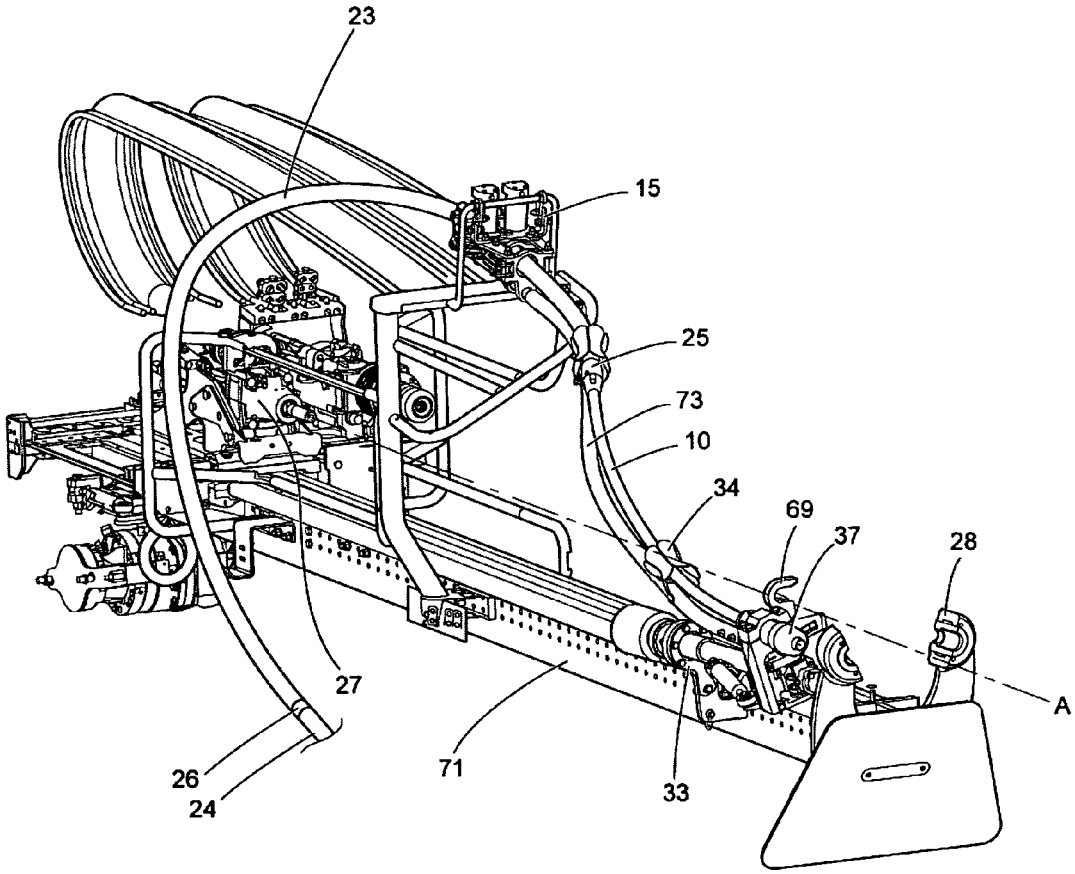
FIG. 5 is the arrangement in FIG. 3 from a different view and in a different position.

In FIG. 5, the turning/rotation actuator 35 is in its parking position with the drilling machine 27 ready to receive a drill steel 29 and to drill a hole during rotation of a drill steel 29 around the axis A, the axis of operation. The drilling machine 27 is moving along the feed holder 4 during drilling and is able to even pass the drill centralizer 28. In the parking position, the positioning device with the guide 37 and the injection pipe 10 are inactive and parked to leave room for the drilling machine.

Considering a sequence of rock bolting first the drilling machine 27 with a drill steel 29 arranged along axis A is drilling a hole 13 (FIG. 5). Second, the drill steel is bent away and the injection device with the guide 37 is positioned along the axis A to inject fixing material (FIG. 3). Third, the positioning device is tilted to its parking position to leave room for insertion of a bolt along axis A by the bolting unit.

Figure 6:
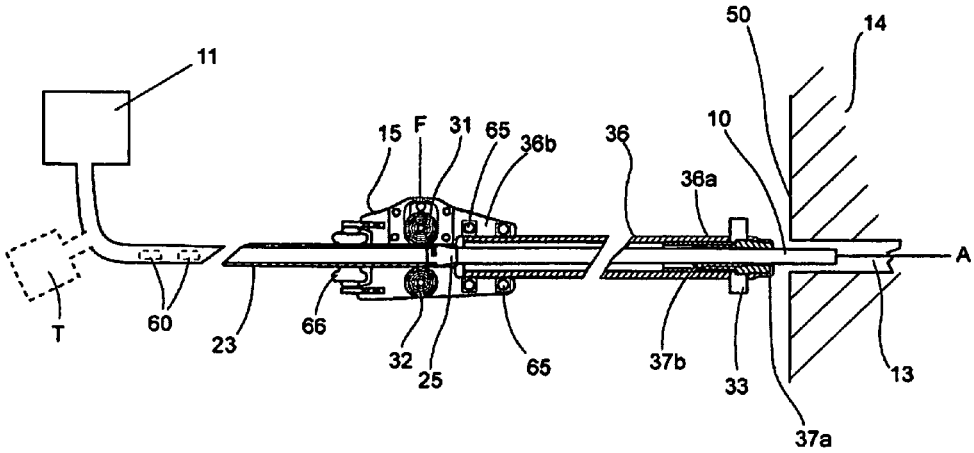
FIG. 6 is part of an alternative injection arrangement according to the invention.

In an alternative injection arrangement (FIG. 6), the hose system comprises an injection pipe 10 and an injection feed hose 23 and thus no injection hose. The injection pipe 10 is connected to the injection feed hose 23 in a first threaded hose coupling 25. A feed unit 15 is arranged to feed the injection feed hose such that the injection pipe 10 is passing internal of a guide hose 36, internal of a guide 37 comprised in the first end 36*a* of the guide hose 36 and further in/out of a drilled hole 13.

A positioning device 33 is arranged between the first end 36*a* of the guide hose 36 and the feed holder 4. The positioning device is explained more in detail in FIG. 7.

The guide 37 comprises a first 79 and a second supporting surface 80 arranged at a distance from each other to achieve a two surfaces guiding of the hose system such that the injection pipe 10 is adjusted to be coaxial with the symmetry axis of the guide.

When the positioning device 33 has precision adjusted the position of the guide 37 in injection position, the symmetry axis of the guide is coaxial with the axis A, the axis of operation i.e. the drill axis.

The injection pipe 10 is moving coaxially with the axis A, the axis of operation, when passing through and leaving the guide 37 in the drilling direction. Thus, an precision adjusted guide is directing along the injection pipe passing through the guide.

The feed unit 15 is connected to the second end 36*b* of the guide hose 36 and is arranged to hang freely on the side of the feed holder 4. Thus, the guide hose 36 together with the injection feed hose 23 manage some bending during operation. This eventual bending is controlled and limited due to the stiffness of the guide hose 36 and there is no risk for breakage of the injection pipe 10 during operation.

At least one pair of backing rollers 65 (one is shown) is arranged on the feed unit 15 to guide the movement of the injection feed hose 23. The design with the feed unit 15 hanging beside the feed boom 4 is very advantageous since the space on the feed beam is limited.

The feed unit comprises a hydraulic actuator adapted to rotate a first 31 and a second feed roller 32 arranged adjacent to each other with the axis of rotation arranged in parallel. The injection feed hose is arranged to pass in between the rollers 31, 32. At least one of the feed rollers 31, 32 is spring-loaded acting on the injection feed hose 23 by a spring force F to secure good contact between the injection feed hose 23 and the feed rollers 31, 32.

In the case of further feed rollers, all feed rollers will be synchronized to eliminate the risk of wear of the injection feed hose 23.

To provide an injection feed hose 23 and an injection pipe 10 passing to and fro inside the guide hose 36, the outer diameter of the first threaded hose coupling 25 has to be smaller than the inner diameter of the guide hose 36.

The guide hose 36 is e.g. a metal hose or a steel armoured hose of relatively high stiffness and the injection feed hose 23 is a steel-wire spring armoured hose, which can stand high contact pressure from the feed rollers 31, 32. This in combination provides for a safe operation without any skidding.

It is very easy to exchange the injection pipe 10, which is considered to be an article of consumption. The guide 37 is detached and the injection pipe 10 with the first threaded hose coupling 25 is free to be feed out of the guide hose 36 in the drilling direction. Then, the first threaded hose coupling 25 is detached and a worn injection pipe can be exchanged for a new one. An exchanged injection pipe attached to the injection feed hose if feed, back into the guide hose, the guide 37 is mounted in the guide hose 36 and the injection operation can continue.

The first threaded hose coupling 25 has the function of a mechanical stop, which limits the movement of the injection pipe 10 both back and forth, where forth is in the drilling direction. The guide 37 limits the movement forth and the feed rollers 32 limit the movement back. Thus, there is no need for any electric distance measuring equipment.

Possible dimensions, here given as examples, are a feeding distance of about 1.5 meter, an injection pipe of about 1.6 meter, a guide hose length of about 1.5 meter and an injection feed hose length of about 2 meters.

The length of the reinforcing means is adjusted to the length of the drilled hole in a known way. The reinforcing means is for example a bolt, a wire or any other suitable means.

The arrangement in FIG. 5 can be used for rock bolting either by pumping cement or by pushing resin cartridges shoot by compressed air from storage means 11.

Figure 7:
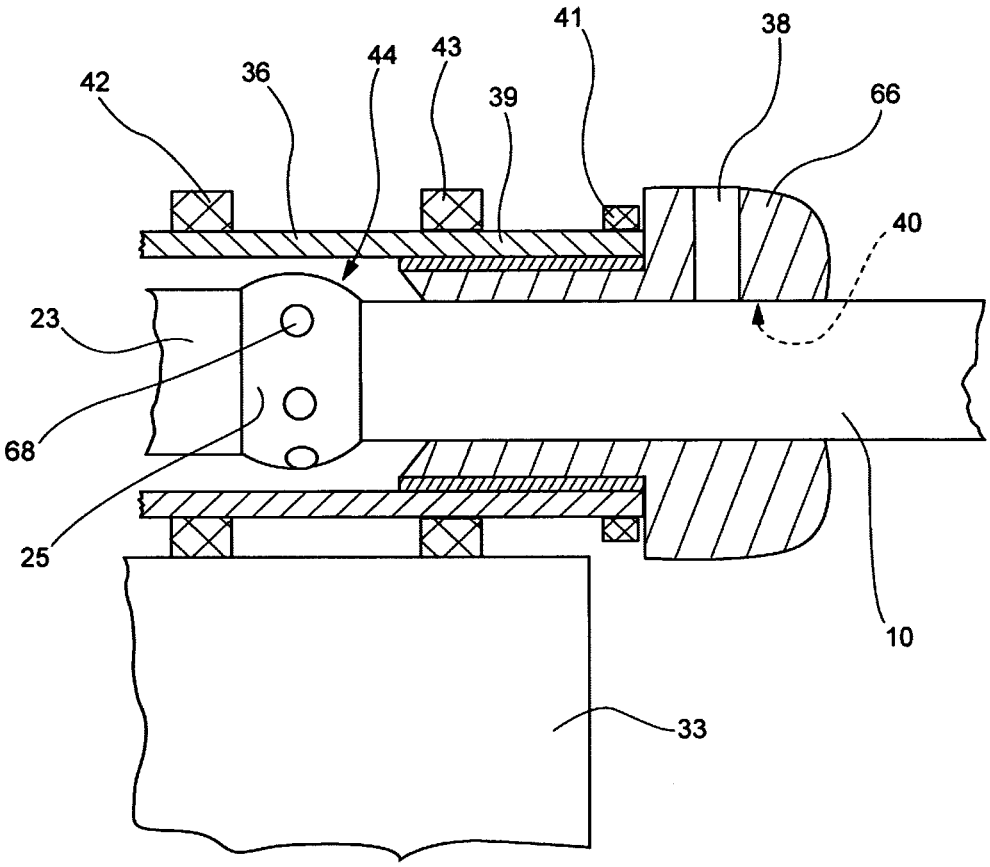
FIG. 7 is a cross section of the guide in FIG. 5.

FIG. 7 is a cross section of an alternative guide 66 according to the invention. Any guide according to the invention is arranged partly inside the hose guide 36 such that the guide can be fastened to the guide hose 36 by a hose clamp 41 arranged on the outer surface of the guide hose 36. The alternative guide 66 comprises a supply inlet 38 for water such that supplied water will flush on the inside 40 of the guide. The water can flow in both directions along the outer surface of the injection pipe 10 and clean the injection pipe 10. At the same time the flushing water will provide water lubrication between the outer surface of the injection pipe 10 and inner surface of the guide 66 as well as between the inner surface of the guide hose 36 and outer surface of the hose system comprising injection pipe 10, first threaded hose coupling 25 and injection feed hose 23 to facilitate the movement of the injection pipe 10.

A steel sleeve 39 is arranged between the guide 66 and the guide hose to avoid bending of the guide. The guide hose 36 is clamped connected to a positioning device 33, which will be explained more in detail below.

Figure 8:
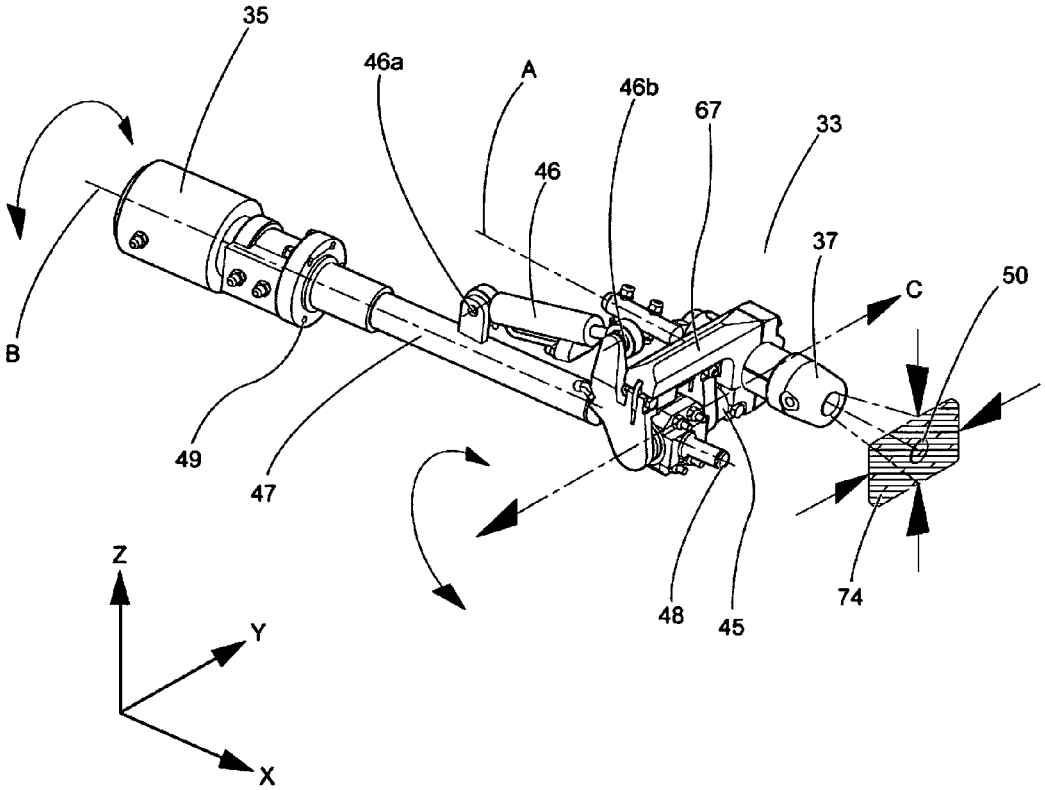
FIG. 8 is a positioning device according to the invention.

FIG. 8 is a part of a mechanized bolting unit 5 comprising a turning/rotation actuator 35 comprising a connection surface 49 fixed connected to a feed beam 71 (FIG. 3). A distance axle 47 is attached coaxially to the turning/rotation actuator 35 in one end for turning along its longitudinal axis B between the three different defined positions, as mentioned above.

The distance axle 47 is in the other end rotatable supported in a bearing means 48 arranged connected to the feed beam 71 (not shown). A positioning device 33 is attached to the distance axle 47 to hold a guide 37 and provide precision adjustment of the guide in relation to a cover area 74 comprising a desired object 50 symbolizing the orifice/entrance of a drilled hole.

Turning/rotating the actuator 35 and consequently the positioning device 33 with the guide 37 into the injection position, as described in FIG. 3, results in an exact positioning within the mechanized bolting unit. Due to certain unavoidable small movements of the drill rig, the tilting into the injection position results in a coarse positioning of the guide in relation to a drill hole to be bolted.

Then, the positioning device will make a precision adjustment of the guide 37 in relation to the hole to be injected and bolted. The precision adjustment is done by moving the guide 37 laterally and linearly along an axis C by operating a first moving means 45, which is a first hydraulic cylinder in FIG. 8. Further, the precision adjustment is also done by tilting/rotating the guide 37 around an axis C with the symmetry axis of the guide in a plane crossing the axis C under right angle by operating a second moving means 46, which is a second hydraulic cylinder in FIG. 8.

The distance axle 47 is turning/rotating around axis B. The positioning device 33 is tilting/rotating around axis C. The goal is to precision adjust the position of the injection pipe 10 to be coaxial to the drill axis/operation axis A during injection operation.

In FIG. 8, axis B and axis C are arranged such that vertical planes through axis B and C are crossing under an obtuse angle.

In FIG. 8, axis C and axis A are arranged such that vertical planes through axis C and A are crossing under right angle.

The operator is visually controlling the position of the guide in relation to the cover area 50 and precision adjusting the guide 37 by operating the first 45 and second hydraulic cylinder 46.

The first hydraulic cylinder arrangement will be explained in connection with FIG. 9*a*.

The second hydraulic cylinder arrangement 46 is pivoted connected (1 degree of freedom) to the distance axle 47 in one end 46*a* and pivoted connected (1 degree of freedom) to the pivoting part 67 of the position device 33 in the other end 46*b*. Operating the second hydraulic cylinder 46 will tilt the pivoting part 67 comprising the guide 37 such that the symmetry axis of the guide is tilting/rotating in a plane perpendicular to the axis C.

Figure 9B:
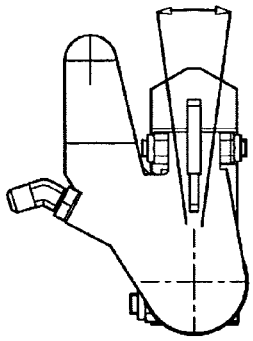
FIG. 9 is part of the positioning device in FIG. 7.
Figure 9A:
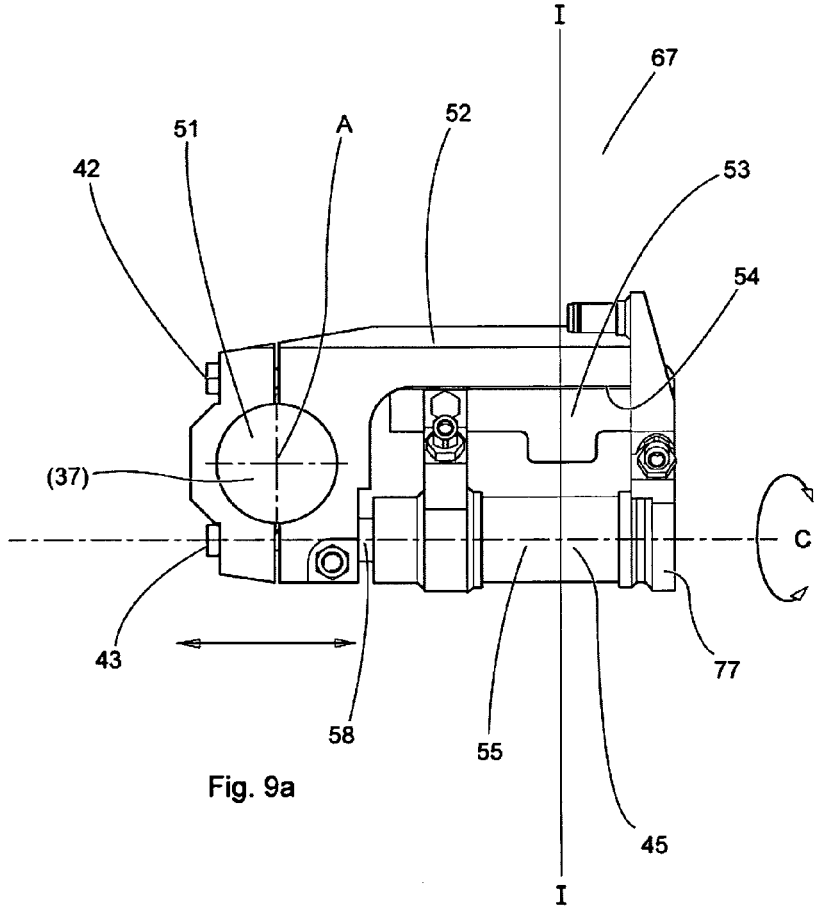

FIG. 9*a* is the tilting part 67 with the first hydraulic cylinder 45 of a positioning device shown more in detail. The first hydraulic cylinder 45 housing 55 is arranged coaxial with the axis C and is connected to the feed beam 71 (FIG. 5) in a connection point 77.

The rod piston 58 of the first hydraulic cylinder 45 is connected to a linear guide 52. The linear guide 52 comprises an opening 51 adapted to receive and hold the guide 37 arranged in the opening 51 and attached by holding means 42, 43. A guided bar 53 is connected to the first cylinder housing 55. Operating the first hydraulic cylinder 45 will initiate the linear guide 52 with the guide 37 to slide along the fixed guided bar 53 and provide a relative movement between the guide 37 and the distance axle 47/the feed beam 71.

FIG. 9*b* is a schematic view of the tilting/rotating movement.

Figure 10:
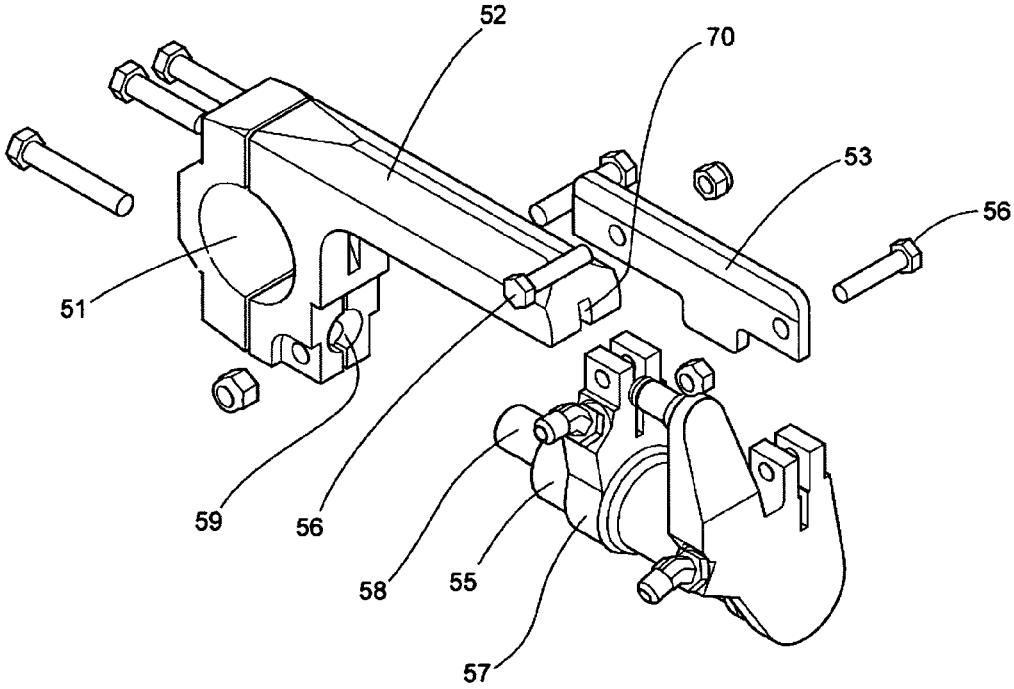
FIG. 10 is an exploded view of the positioning device in FIG. 8.

FIG. 10 shows some parts of the positioning device i.e. the linear guide 52 comprising a groove 70 and the guided bar 53. Further, the linear guide 52 comprises a bore 59 and holding means (not shown) for receiving and connecting the rod piston 58 to the linear guide 52, as described above. The first hydraulic cylinder housing 55 is integrated with a holding means 57. The guided bar 53 is connected to the holding means 57 by fastening means 56.

Figure 11:
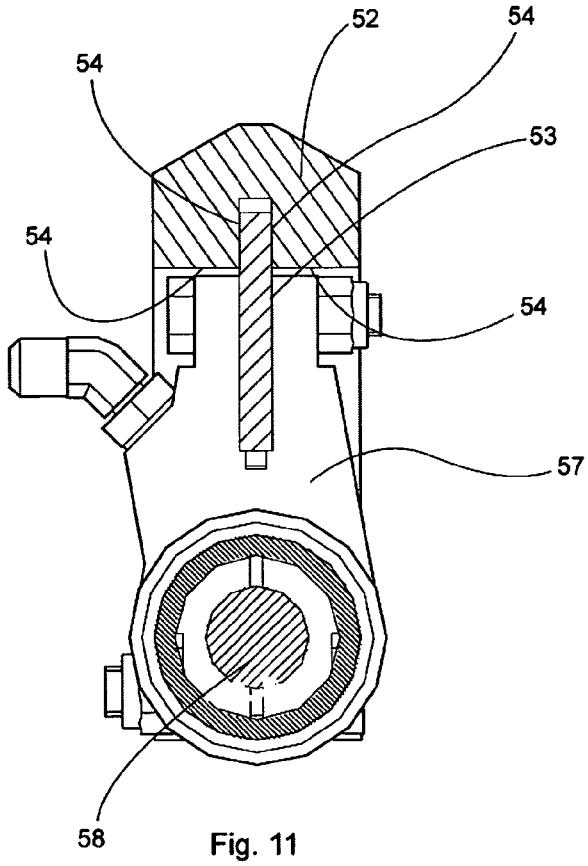
FIG. 11 is a cross section along the line I-I in FIG. 7.

FIG. 11 is a cross section along the line I-I in FIG. 9*a*. The design of the linear guide 52, the guided bar 53 and the holding means 57 provides a very rigid and shockproof positioning unit.

The relative dimensions of the linear guide 52, the guided bar 53 and the holding means 57 creates a sliding surface 54 on both sides of the guided bar resulting in a relatively large sliding surface providing a powerful linear unit within the positioning device.

Further, the design of the first cylinder 45, guided bar 53 and the holding means 57 provides a stable and robust support for the sliding part of the positioning device. This in turn provides a relative movement of high precision during operation.

Figure 12:
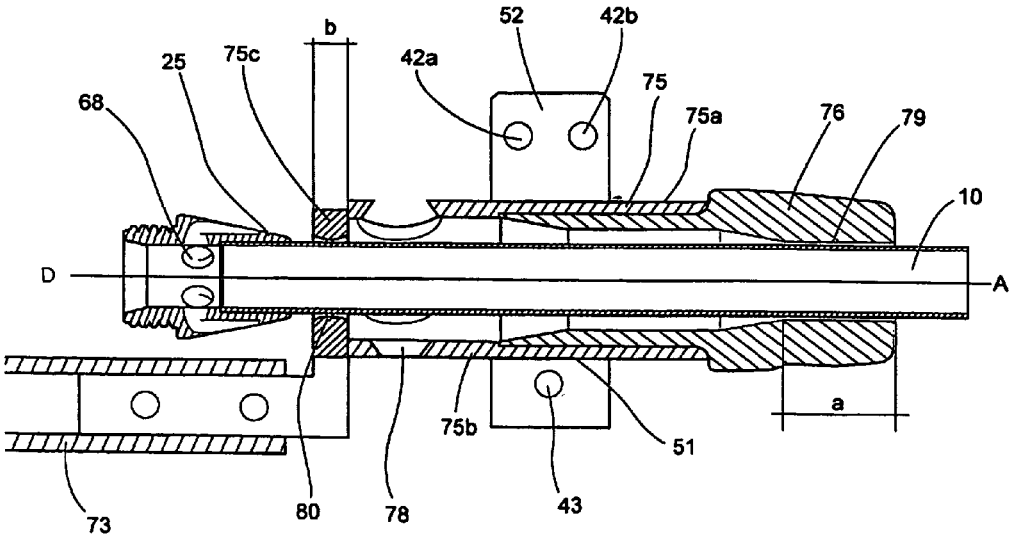
FIG. 12 is a cross section of a guide and an injection tube according to an alternative of the invention.

FIG. 12 is a cross section of an alternative guide 76 comprising a first guiding surface 79 and a second guiding surface 80. The guide 76 is inserted in one end 75*a* of a slotted socket 75 and both the guide 76 and socket 75 are clamped in an opening 51 in a linear guide 52 with fastening means 42, 43. The socket 75 comprises at least one radial air outlet 78 in the other end 75*b*, providing a way out for small pieces of rock and water.

The first threaded hose coupling 25 comprises at leas one radial passage 68 through which air internal the injection pipe can flow out. This design provides compressed air internal of the guide and socket to flow out instead of creating an increased air pressure inside the guide during injection of cartridges. This eliminates the risk of the injection pipe being pushed out from the drill hole due to increased air pressure.

The socket further comprises a guiding part 75*c* in the second end 75*b*. The guiding part comprises a second guiding surface 80, which together with the first guiding surface is adapted to guide the injection pipe 10. The first guiding surface 79 has an extension a along the axis A, and the second guiding surface 80 has an extension b along the axis A. The surfaces are arranged at a distance along the symmetry axis of the guide such that the guide adjusts the orientation of an injection pipe 10 passing through the guide. Thus any inclination of the injection pipe 10 is adjusted during passage through the guide such that the injection pipe is coaxial with the symmetry axis D of the guide when leaving the guide due to the two guiding surfaces.

The supporting hose 73 comprising the hose guides 34 is connected to the socket 75 by holding means 81 (FIG. 5).

Figure 13:
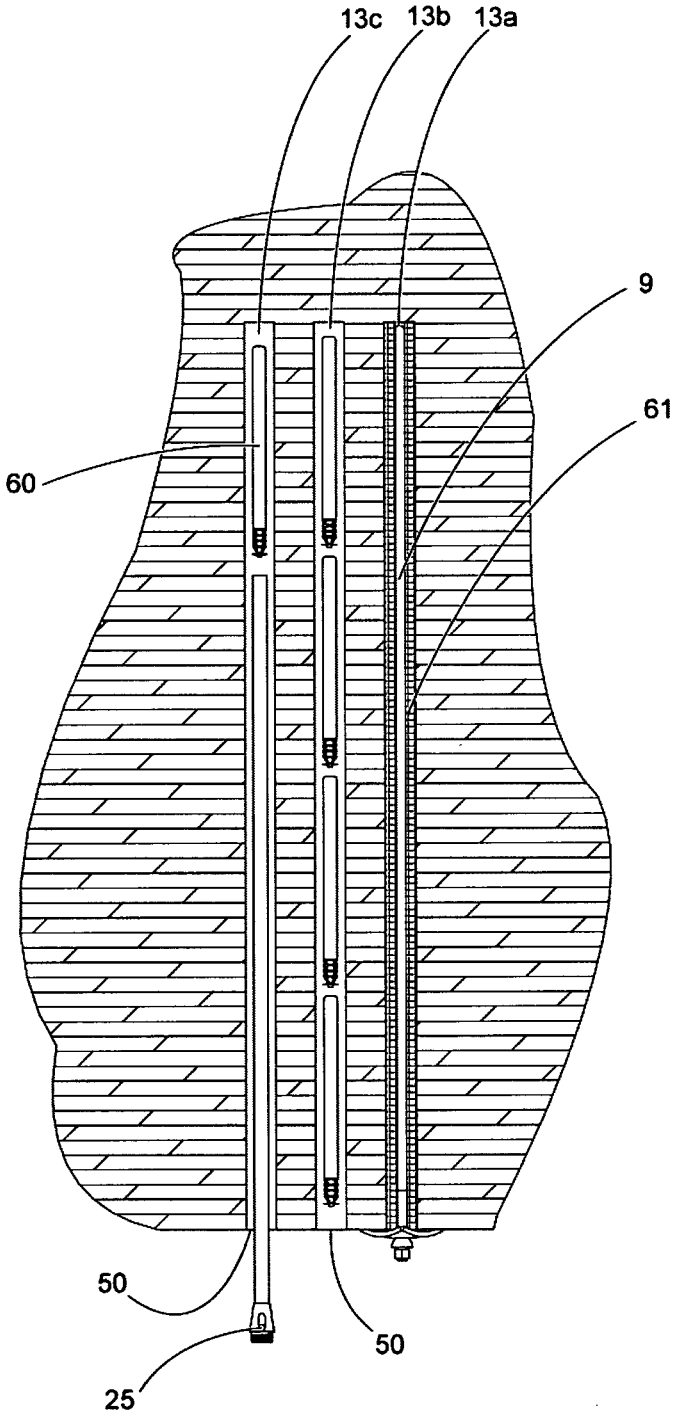
FIG. 13 is a schematic cross section of a rock during rock bolting.

FIG. 13 is a cross section in a rock comprising three drill holes 13*a, b, c* during different stages of rock bolting. Resin cartridges 60 are shoot into a drill hole 13*a*. The drill hole 13*b* is filled with cartridges and waiting for bolting. The drill hole 13*c* is bolted with a bolt 9, solidified fixing material 61, protecting plate 82 and threaded nut 83.

The rock bolting method according to the invention is operated according to the following.

The drilling machine 27 with a drill steel 29 arranged along axis A is drilling a hole 13 (FIG. 5).

The drill steel is bent away and the injection device with the guide 37 is positioned along the axis A. The positioning is achieved in that the first 45 and the second moving means 46 are operated by an operator, who visually controls the adjustment of the guide 36 and operates the moving means until the guide with the injection pipe is arranged coaxial with the longitudinal axis of a drill hole.

The actual fixing material is injected in the hole.

The positioning device is tilted to its parking position to leave room for insertion of a bolt along axis A by the bolting unit.

The bolt is inserted into the filled hole during rotation and is rotated until the fixing material is solidified.

Finally, a plate and nut are attached to the bolt, as described above.

The invention claimed is:

1. An injection device for injecting fixing material in a drill hole during rock bolting, said injection device comprising a hose system and a feed unit, wherein the hose system comprises an injection pipe and an injection feed hose connected to the injection pipe such that movement of the injection feed hose results in movement of the injection pipe; the injection device further comprising a guide for guiding the injection pipe and a positioning device for adjusting the position of the guide and the injection pipe relative to the drill hole for supplying fixing material into the drill hole during operation; said positioning device including one driver for moving said guide and thus said injection pipe along a first axis into one position relative to said drill hole, and another driver for moving said guide and thus said injection pipe relative to said first axis into another position relative to the drill hole, for more precisely aligning said guide and thus said injection pipe relative to said drill hole; wherein said one driver moves the guide laterally along said first axis into said one position, and said another driver tilts the guide into said another position by rotating the guide relative to said first axis.

2. The injection device according to claim 1, wherein the feed unit is coupled directly to the injection feed hose.

3. The injection device according to claim 1, wherein the guide comprises two separate guiding surfaces arranged separated along an axis (D) of symmetry extending through the guide.

4. The injection device according to claim 1, wherein said one driver moves the guide both linearly and laterally along said first axis into said one position.

5. A drill rig comprising the injection device according to claim 1.

6. A drill rig comprising an injection device according to claim 2.

7. The injection device according to claim 1, wherein said feed unit comprises a pair of feed rollers for driving said injection feed hose.

8. A method of injecting fixing material by an injection device in a drill hole during rock bolting, in which the injection device comprises a hose system including an injection pipe for supplying fixing material into the drill hole and an injection feed hose connected to the injection pipe such that movement of the injection feed hose results in movement of the injection pipe, and a feed unit comprising a feeder for feeding the injection feed hose such that the injection pipe enters the drill hole, and a positioning device for adjusting the position of a guide for guiding the injection pipe relative to the drill hole, the method comprising the steps of:

Moving the guide and thus the injection pipe laterally along a first axis into one position relative to said drill hole;

Moving the guide and thus the injection pipe relative to the first axis into another position relative to said drill hole by tilting the guide relative to said first axis for more precisely aligning the injection pipe with the drill hole;

Supplying fixing material into the drill hole through the injection pipe, and

Removing the injection pipe from the drill hole by said feed unit.

9. The method according to claim 8, comprising the step of moving the positioning device with the guide into an injection position such that the orientation of an axis of symmetry of the guide is adjusted relative to an axis extending through the drill hole.

10. The method according to claim 8, comprising the step of adjusting the guide with the injection pipe until the injection pipe has a longitudinal axis coaxial with an axis extending through the drill hole.

11. The method according to claim 9, comprising the step of adjusting the guide with the injection pipe until the injection pipe has a longitudinal axis thereof coaxial with an axis extending through the drill hole.

12. The method according to claim 8, including the step of moving said one driver both linearly and laterally into said one position along said first axis.

* * * * *